US009546632B2

(12) United States Patent
Yamada et al.

(10) Patent No.: US 9,546,632 B2
(45) Date of Patent: Jan. 17, 2017

(54) TWO-STROKE ENGINE WITH FUEL INJECTION

(71) Applicant: HONDA MOTOR CO., LTD., Tokyo (JP)

(72) Inventors: Yoshikazu Yamada, Saitama (JP); Mashu Kurata, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 34 days.

(21) Appl. No.: 14/514,600

(22) Filed: Oct. 15, 2014

(65) Prior Publication Data

US 2015/0184574 A1 Jul. 2, 2015

(30) Foreign Application Priority Data

Dec. 26, 2013 (JP) ..... 2013-269850

(51) Int. Cl.

| | |
|---|---|
| ***F01P 1/04*** | (2006.01) |
| ***F02M 61/14*** | (2006.01) |
| ***F02B 33/04*** | (2006.01) |
| ***F02B 41/00*** | (2006.01) |
| ***F02M 69/04*** | (2006.01) |

(Continued)

(52) U.S. Cl.

CPC ..... *F02M 61/14* (2013.01); *F02B 25/04* (2013.01); *F02B 33/04* (2013.01); *F02B 41/00* (2013.01); *F02D 15/02* (2013.01); *F02M 26/01* (2016.02); *F02M 69/042* (2013.01); *F01M 1/08* (2013.01); *F01P 3/08* (2013.01); *F02B 3/06* (2013.01); *F02B 2075/025* (2013.01); *F02F 3/22* (2013.01); *F05C 2201/021* (2013.01)

(58) Field of Classification Search

CPC ..... F01P 3/08; F02F 3/22; F01M 1/08; F02B 3/06; F05C 2201/021

USPC ..... 123/41.35

See application file for complete search history.

(56) References Cited

U.S. PATENT DOCUMENTS

2006/0272599 A1* 12/2006 Johnson ..... F02B 17/005 123/73 A
2007/0044740 A1* 3/2007 Watanabe ..... F02B 75/048 123/78 F

FOREIGN PATENT DOCUMENTS

CN 200949488 Y 9/2007
JP S47-23252 6/1972

(Continued)

OTHER PUBLICATIONS

Office Action dated Jun. 7, 2016, issued in counterpart Japanese application No. 2013-269850, with English translation. (7 pages).

(Continued)

*Primary Examiner* — Lindsay Low
*Assistant Examiner* — Charles Brauch
(74) *Attorney, Agent, or Firm* — Westerman, Hattori, Daniels & Adrian, LLP

(57) ABSTRACT

In a two-stroke engine including a scavenging port (43*b*) having an open end (42*d*) opening out in a side wall of the cylinder bore (3*a*) and communicating with a crank chamber (2*a*), the open end being configured to be closed and opened by the piston (22), a fuel injection device (71) is mounted on the engine main body so as to inject fuel onto a back side of the piston and/or a part of the side wall of the cylinder bore located under the piston via the open end of the scavenging port or via the open lower end of the cylinder bore. The fuel deposited on the surfaces of the piston and the cylinder inner wall promotes the cooling of such parts.

9 Claims, 7 Drawing Sheets

(51) Int. Cl.

| | |
|---|---|
| ***F02B 25/04*** | (2006.01) |
| ***F02D 15/02*** | (2006.01) |
| *F02B 75/02* | (2006.01) |
| *F02F 3/22* | (2006.01) |
| *F01M 1/08* | (2006.01) |
| *F01P 3/08* | (2006.01) |
| *F02B 3/06* | (2006.01) |

(56) References Cited

FOREIGN PATENT DOCUMENTS

| | | | |
|---|---|---|---|
| JP | 61-101655 | A | 5/1986 |
| JP | 03-26820 | A | 2/1991 |
| JP | 04-237815 | A | 8/1992 |
| JP | 4-311622 | A | 11/1992 |
| JP | 9-79116 | A | 3/1997 |
| JP | 2008-111387 | A | 5/2008 |

OTHER PUBLICATIONS

U. Adler et al., Automotive Handbook, pp. 337-338, China Machine Press, Dec. 1987, (Cited in Chinese Office Action dated Sep. 30, 2016) w/English Translation.

Office Action dated Sep. 30, 2016 issued in corresponding Chinese Patent Application No. 2014108582424.4, 11 pages. (w/ partial English translation).

* cited by examiner

TWO-STROKE ENGINE WITH FUEL INJECTION

TECHNICAL FIELD

The present invention relates to a two-stroke engine, and in particular to a two-stroke engine with fuel injection.

BACKGROUND OF THE INVENTION

The two-stroke engine is often preferred over the four-stroke engine in the field of general purpose engines because of the simplicity in the structure. The two-stroke engine is often not provided with any lubrication system, and the required lubrication is achieved by the use of mixed fuel containing lubricating oil. As the fuel is supplied to the crank chamber before being forwarded to the combustion chamber, the various rotating parts and sliding surfaces are lubricated. The lubricating oil is also known to be useful in removing heat from various moving parts. However, because the lubricating oil supplied in this manner is highly limited in quantity, as compared to the case of a four-stroke engine equipped with a lubricating oil recirculation system, cooling of the piston and the cylinder is a major problem in the two-stroke engine.

It has been proposed to form a passage in a two-stroke engine opening out toward the back side of the piston, and to blow compressed air against the back side of the piston via this passage. See JP04-237815A, for instance. It has also been proposed to provide a guide plate extending at an angle to the cylinder axial line on the back side of the piston such that gas may be guided to the back side of the piston as the piston moves downward for the purpose of cooling the piston. See JP61-101655A, for instance. In the two-stroke engine disclosed in JP61-101655A, an opening is formed in the skirt of the piston so as to communicate with the intake port during the downward stroke of the piston. The mixture mixed with fuel in the intake port is conducted through the intake port, the opening, a space on the back side of the piston and the crank chamber, in that order, and this flow cools the piston. According to yet another proposal, an opening is formed in the skirt of the piston such that the mixture may be conducted through the crank chamber, a space on the back side of the piston, a scavenging port and the combustion chamber. See JP03-026820A, for instance.

However, according to the invention disclosed in JP04-237815A, in addition to a pump, special passages are required in the engine so that the complexity and the size of the engine inevitably increase. As for the invention disclosed in JP61-101655A and JP03-026820A, the piston is required to have a skirt having an opening formed therein so that the compatibility is impaired, and the manufacturing cost increases.

SUMMARY OF THE INVENTION

In view of such problems of the prior art, a primary object of the present invention is to provide a two-stroke engine which allows the piston thereof to be cooled in a favorable manner.

To achieve such an object, the present invention provides a two-stroke engine, comprising: a piston slidably received in a cylinder bore defined in an engine main body; a scavenging port having an open end opening out in a side wall of the cylinder bore and communicating with a crank chamber, the open end being configured to be closed and opened by the piston; and a fuel injection device mounted on the engine main body and configured to inject fuel onto a back side of the piston and/or a part of the side wall of the cylinder bore located under the piston.

Owing to the deposition of fuel on the back side of the piston and/or the inner circumferential surface of the cylinder bore, the cylinder and the piston are favorably cooled. Also, the fuel is allowed to evaporate and otherwise favorably atomized owing to the contact with high temperature surfaces such as the piston and the cylinder wall. The part "located under the piston" is based on the assumption that the cylinder is placed in a normal upright orientation, but should be interpreted as meaning the crankcase side of the piston when the cylinder is placed in any other orientation.

Preferably, the fuel injection device is mounted on a part of the engine main body defining a part of the scavenging port.

Thereby, the fuel may be injected onto the aimed parts without being obstructed by the crankshaft, and owing to the short distance which the fuel has to travel to reach the aimed parts, the fuel can be efficiently delivered to the aimed parts.

In order to maximize the amount of fuel that is delivered to the aimed parts, the fuel injection device may be configured to inject fuel at a timing when the piston is near a top dead center thereof, and a part of the cylinder bore located under the piston communicates with the scavenging port.

To allow the fuel injection device to be mounted in a relatively spacious part of the engine main body while ensuring an efficient delivery of fuel to the aimed parts, a fuel injection axial line of the fuel injection device may be directed obliquely upward so as to pass through the open end of the scavenging port. Alternatively, the fuel injection axial line of the fuel injection device may pass through an open lower end of the cylinder bore.

The fuel injection device is configured to inject liquid fuel so that the removal of heat from the piston and the cylinder wall may be enhanced by the evaporation of the fuel.

To provide a favorable lubrication between the cylinder wall and the piston, the liquid fuel may consist of diesel oil or any other fuel that is provided with a lubricating property.

According to a particularly preferred embodiment of the present invention, the engine further comprises a crankshaft extending in the engine main body with an offset relative to an axial line of the cylinder bore and provided with a crankpin, a trigonal link having a middle part pivotally supported by the crankpin, a connecting rod having a first end pivotally connected to an end of the trigonal link and a second end pivotally connected to the piston, and a swing link having a first end pivotally connected to another end of the trigonal link and a second end pivotally connected to the engine main body, wherein the fuel injection device is mounted on a part of the engine main body adjacent to the crank chamber and located on a side of the cylinder bore axial line remote from the axial line of the crankshaft such that fuel ejected from the fuel injection device is directed into the cylinder bore.

Thereby, the fuel ejected from the fuel injection device on the side of the crank chamber can be efficiently delivered to the aimed parts such as the back side of the piston and the inner circumferential surface of the cylinder wall without being obstructed by the crankshaft or the associated linkage members.

BRIEF DESCRIPTION OF THE DRAWINGS

Now the present invention is described in the following with reference to the appended drawings, in which.

DESCRIPTION OF THE PREFERRED EMBODIMENT(S)

The first embodiment of the present invention consisting of a uni-flow type, single cylinder, two-stroke engine (engine E1) is described in the following with reference to FIGS. 1 to 5.

Figure 1:
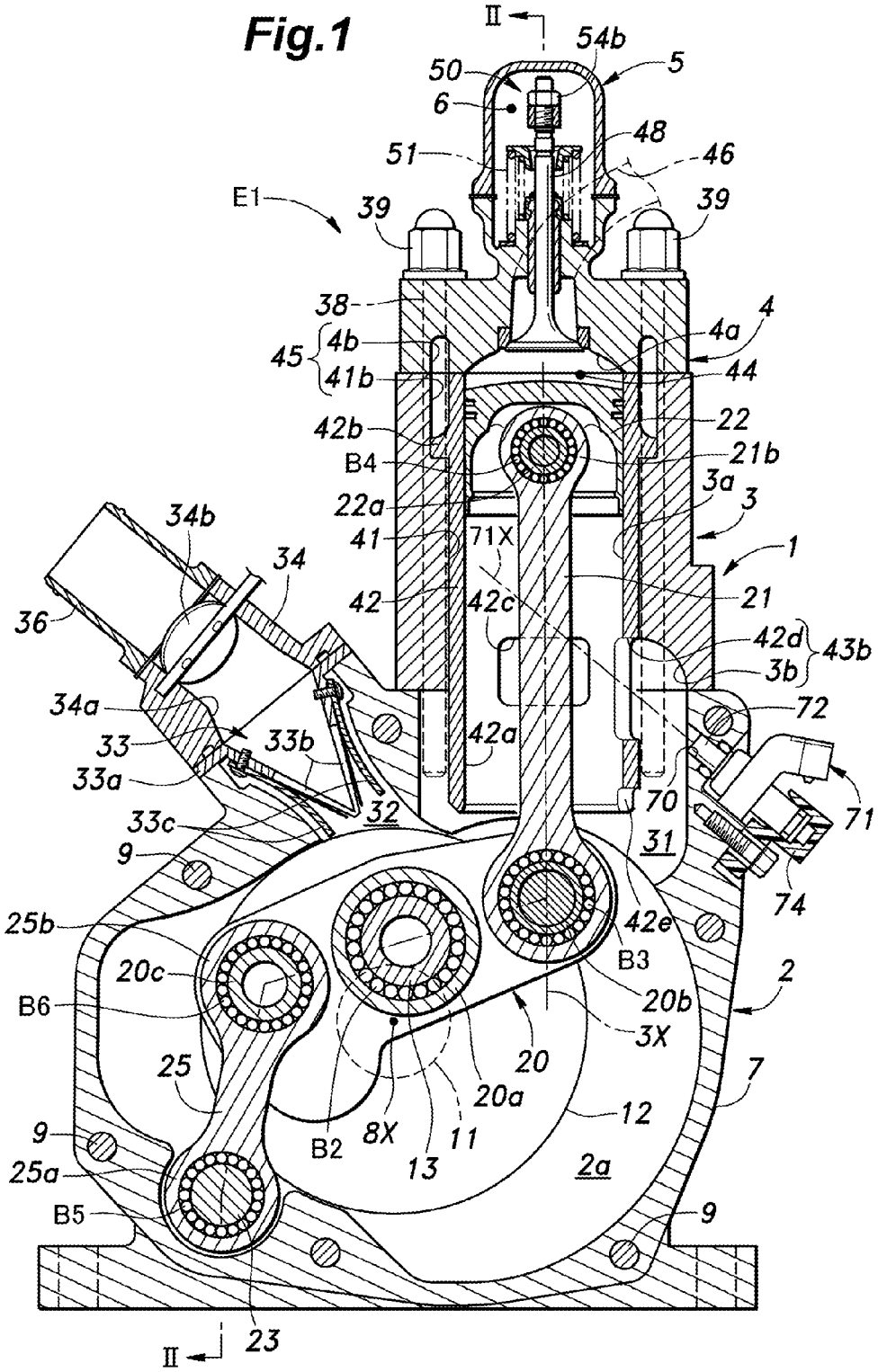
FIG. 1 is a vertical sectional view of an engine given as a first embodiment of the present invention (taken along line I-I of FIG. 2)
Figure 2:
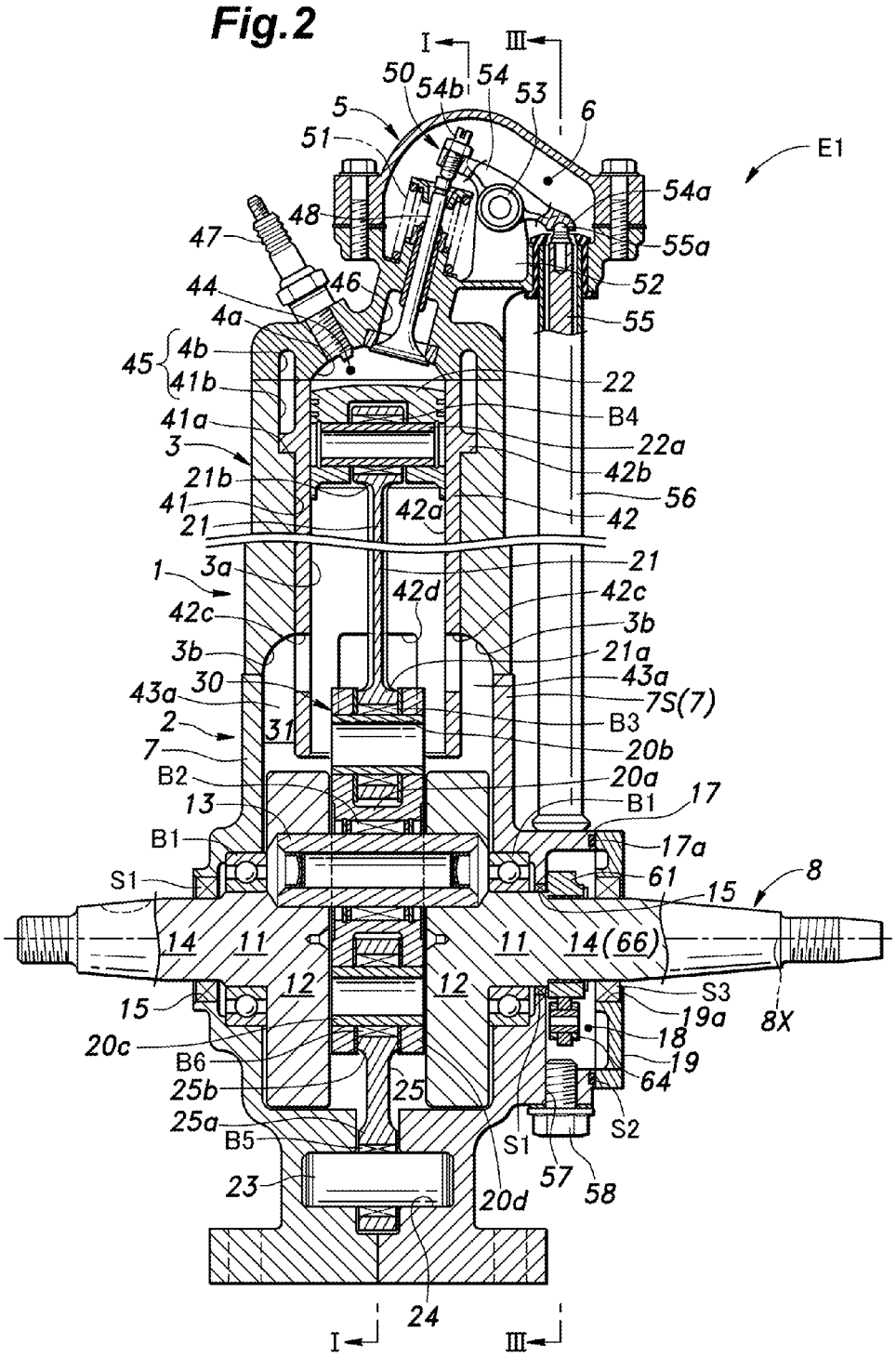
FIG. 2 is a sectional view taken along line II-II of FIG. 1.

Referring to FIGS. 1 and 2, an engine main body 1 of the engine E1 is provided with a crankcase 2 defining a crank chamber 2*a* therein, a cylinder block 3 connected to the upper end of the crankcase 2 and defining a cylinder bore 3*a* therein, a cylinder head 4 connected to the upper end of the cylinder block 3 and a head cover 5 attached to the upper end of the cylinder head 4 to define an upper valve chamber 6 in cooperation with the cylinder head 4.

Figure 3:
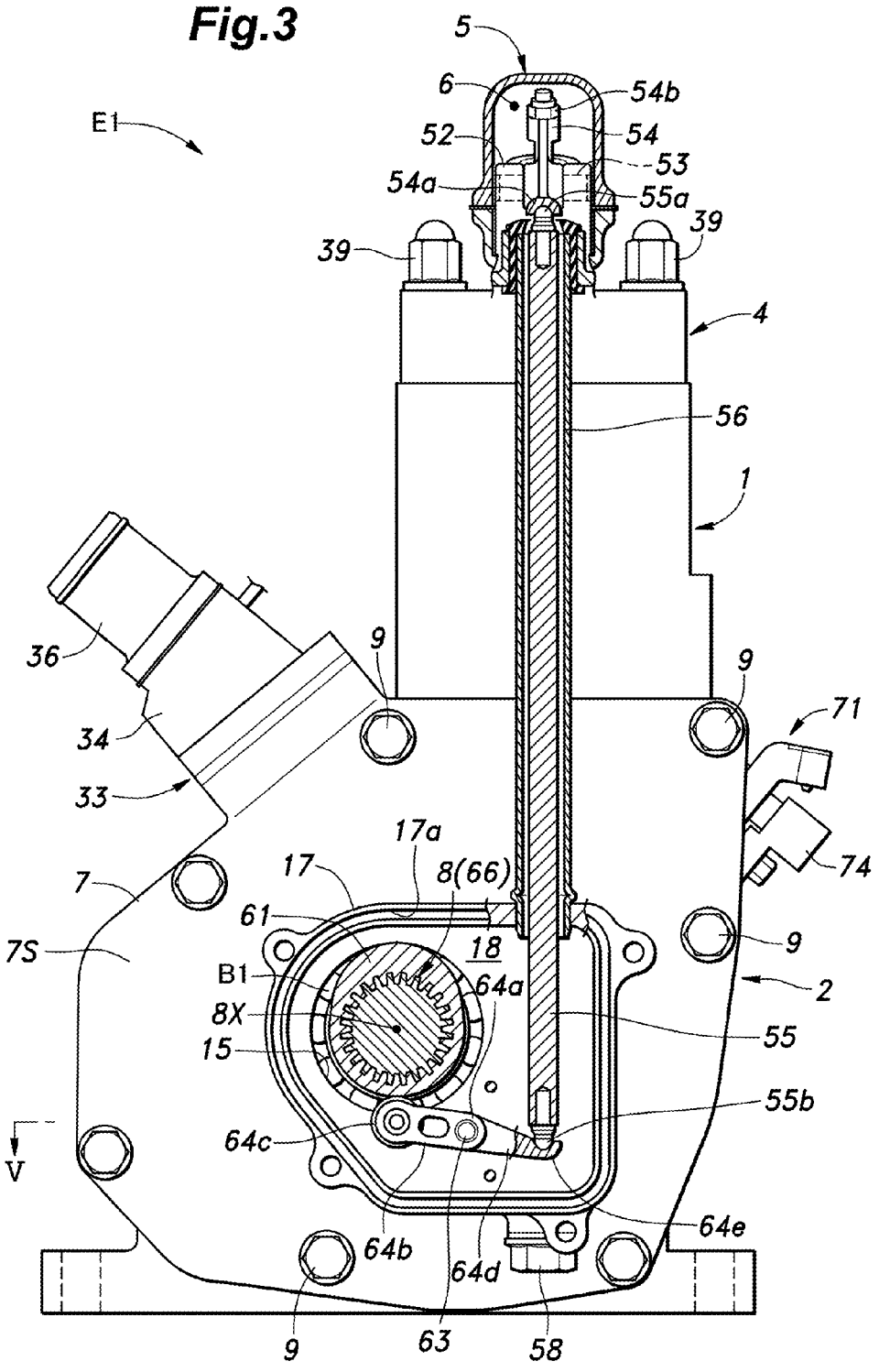
FIG. 3 is a sectional view taken along line III-III of FIG. 2.

As best shown in FIG. 2, the crankcase 2 consists of two crankcase halves 7 having a parting plane extending perpendicularly to the crankshaft axial line 8X and joined to each other by seven threaded bolts 9 (FIGS. 1 and 3). Each crankcase half 7 includes a side wall 7S which is provided with an opening through which the corresponding end of a crankshaft 8 projects, and the corresponding end of the crankshaft 8 is rotatably supported by the side wall 7S via a first bearing B1. Thus, the crankshaft 8 is rotatably supported at two ends thereof by the crankcase 2, and has a crank throw received in the crank chamber 2*a* defined by the crankcase 2.

The crankshaft 8 includes a pair of journals 11 that are rotatively supported by the first bearings B1, respectively, a pair of crank webs 12 extending radially from middle parts of the crankshaft 8, a crankpin 13 extending between the two webs 12 radially offset from and in parallel with the axial line 8X of the crankshaft 8, and a pair of extensions 14 extending coaxially from the outer ends of the journals 11 out of the crankcase 2. Each crank web 12 is formed as a circular disk defining a larger radius than the outer profile of the crankpin 13 so as to serve as a flywheel that stabilizes the rotation of the crankshaft 8.

Each extension 14 of the crankshaft 8 extends out of the crankcase 2 via a through hole 15 formed in the side wall 7S of the corresponding crankcase half 7. The outer side of each ball bearing B1 is fitted with a seal S1 to ensure an air tight seal of the crank chamber 2*a*. As shown in FIGS. 2 and 3, the side wall 7S of the right crankcase half 7 is integrally formed with a lower valve case 17 protruding therefrom so as to surround the right extension 14 of the crankshaft 8 as seen in FIG. 2.

The lower valve case 17 is cylindrical in shape with an open outer axial end, and internally defines a lower valve chamber 18. The opening of the outer end of the lower valve case 17 is closed by a valve chamber lid 19. The outer axial end of the lower valve case 17 is provided with an annular seal groove 17*a* so that the valve chamber lid 19 may be joined to the opening of the lower valve case 17 in an air tight manner via a second seal member S2 received in the seal groove 17*a*.

The right end of the crankshaft 8 as seen in FIG. 2 is passed through a through hole 19*a* formed in the valve chamber lid 19, and extends further outward. The inner circumference of the through hole 19*a* is provided with a third seal member S3 for ensuring the airtight condition of the lower valve case 17, and hence the airtight condition of the crank chamber 2*a*.

As shown in FIG. 1, the central axial line 8X of the crankshaft 8 or the axial center of the journals 11 is offset from the cylinder axial line 3X to a side (left side in FIG. 1). The crankpin 13 rotates around the central axial line 8X of the crankshaft 8 as the crankshaft 8 rotates, and rotatably supports a middle point of a trigonal link 20 via a tubular portion 20*a* of the trigonal link 20. A second bearing B2 is interposed between the crankpin 13 and the tubular portion 20*a*.

The trigonal link 20 includes a pair of plates 20*d* that are joined by the tubular portion 20*a* in a mutually parallel relationship, and a pair of connecting pins (a first connecting pin 20*b* and a second connecting pin 20*c*) fixedly passed between the two plates 20*d*. These connecting pins 20*b* and 20*c* and the crankpin 13 form three pivot points that are arranged in a line at a substantially same interval with the crankpin 13 located in the middle.

The first connecting pin 20*b* located on the side of the cylinder axial line 3X is pivotally connected to a big end 21*a* of a connecting rod 21 via a third bearing B3. A small end 21*b* of the connecting rod 21 is pivotally connected to a piston 22 slidably received in the cylinder bore 3*a* via a piston pin 22*a* and a fourth bearing B4.

A pivot shaft 23 is fixedly provided in a lower part of the crankcase 2, on the side remote from the first connecting pin 20*b*. The rotational center lines of the pivot shaft 23 and the three pivot points (20*a*, 20*b* and 20*c*) are all in parallel to one another. As shown in FIG. 2, the pivot shaft 23 is press fitted into a pair of mutually opposing holes 24 formed in the two halves of the crankcase 2, respectively. A base end 25*a* of a swing link 25 is pivotally connected to the pivot shaft 23 via a fifth bearing B5. The swing link 25 extends substantially upward from the base end 25*a* thereof, and an upper end or a free end 25*b* of the swing link 25 is pivotally supported by the second connecting pin 20*c* (remote from the cylinder axial line 3X) via a sixth bearing B6.

The engine E1 is thus provided with a multiple link mechanism 30 which includes the trigonal link 20 and the swing link 25 in addition to the connecting rod 21. The multiple link mechanism 30 converts the linear reciprocating movement of the piston 22 into a rotational movement of the crankshaft 8. The dimensions and positions of the various components of the multiple link mechanism 30 are selected and arranged such that a prescribed compression ratio selected for the properties of the particular fuel may be achieved. The compression ratio is selected such that the pre-mixed mixture may self-ignite in an appropriate manner. The fuels that may be used for this engine include gasoline, diesel fuel, kerosene, gas (utility gas, LP gas and so on), etc.

Owing to the use of the multiple link mechanism 30, for the given size of the engine E1, the piston stroke L can be maximized so that a larger part of the thermal energy can be converted into kinetic energy, and the thermal efficiency of the engine E1 can be improved. More specifically, as shown in part (A) of FIG. 4, when the piston 22 is at the top dead center, the big end 21*a* of the connecting rod 21 which is connected to the first connecting pin 20*b* at the right end of the trigonal link 20 is located higher than the crankpin 13 by a first distance D1. Furthermore, as shown in part (B) of FIG. 4, when the piston 22 is at the bottom dead center, the big end 21*a* of the connecting rod 21 is located lower than the crankpin 13 by a second distance D2. Therefore, as compared to the conventional engine where the big end 21*a* of the connecting rod 21 is directly connected to the crankpin 13, the piston stroke L can be extended by the sum of these two distances or by D1+D2. Therefore, the piston stroke L of the engine E1 can be extended without increasing the size of the crankcase 2 or the overall height of the engine E1.

Figure 4:
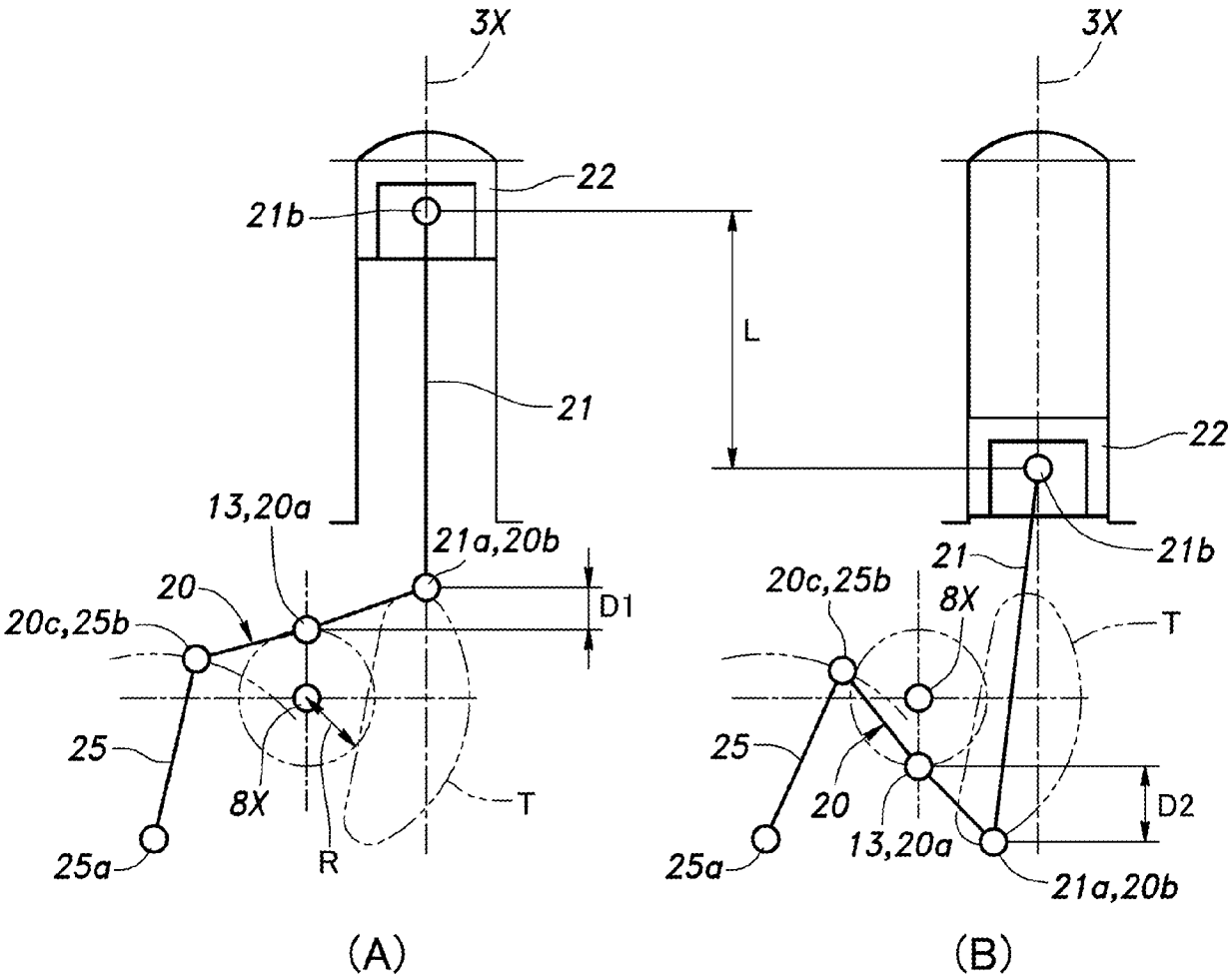
FIG. 4 is a diagram showing the mode of operation of a multiple linkage mechanism used in the engine.

In this engine E1, the trajectory T of the big end 21*a* of the connecting rod 21 is vertically elongated, instead of being truly circular, as shown in (A) and (B) of FIG. 4. In other words, as compared to the more conventional reciprocating engine having the constant crank radius R, the swing angle of the connecting rod 21 is reduced. Therefore, the interferences between the lower end of the cylinder (or lower end of the cylinder sleeve 42) and the connecting rod 21 can be avoided even when the cylinder bore 3*a* is relatively small. Furthermore, the reduction in the swing angle of the connecting rod 21 contributes to the reduction in the thrust loads which the piston 22 applies to the two sides (thrust side and anti-thrust side) of the cylinder wall.

As shown in FIG. 1, the crank chamber 2*a* is laterally extended in the region of the swing link 25 and is vertically extended in the region directly under the piston 22 so that the trigonal link 20 that undergoes a composite rotational movement, the swing link 25 that undergoes a swinging movement and the connecting rod 21 that undergoes a vertically elongated circular movement may not interfere with one another. The part of the crankcase 2 adjoining the lower end of the cylinder bore 3*a* is formed with a cylindrical recess 31 having a circular cross section (taken along a horizontal plane) substantially coaxial with the cylinder bore 3*a* and surrounding the lower end of the cylinder sleeve 42 such that an annular space communicating with the crank chamber 2*a* is defined around the lower end of the cylinder sleeve 42.

An intake port 32 is formed by a tubular extension of the crankcase 2 extending obliquely upward adjacent to the cylindrical recess 31 in the upper part of the crankcase 2. The intake port 32 is fitted with a reed valve 33 that permits the flow of air from the intake port 32 to the crank chamber 2*a*, and prohibits the flow of air in the opposite direction. The reed valve 33 includes a base member 33*a* consisting of a wedge shaped member having a pointed end directed inward and a pair of openings defined on either slanted sides thereof, a pair of valve elements 33*b* mounted on the base member 33*a* so as to cooperate with the openings thereof and a pair of stoppers 33*c* placed on the backsides of the valve elements 33*b* so as to limit the opening movement of the valve elements 33*b* within a prescribed limit. The reed valve 33 is normally closed, and opens when the piston 22 moves upward and the internal pressure in the crank chamber 2*a* thereby drops.

To the outer end of the intake port 32 is connected a throttle body 34 so as to define an intake passage 34*a* extending vertically as a smooth continuation of the intake port 32. A throttle valve 34*b* is pivotally mounted on a horizontal shaft for selectively closing and opening the intake passage 34*a*. The upstream end of the throttle body 34 is connected to an L shaped intake pipe 36 including a vertical section connected to the throttle body 34 and a horizontal section extending away from the cylinder block 3.

Four stud bolts 38 are secured to the upper side of the crankcase 2 and extend upward around the cylinder bore 3*a* at a regular interval as can be seen from FIG. 1. The cylinder block 3 and the cylinder head 4 are secured to the crankcase 2 by passing the stud bolts 38 therethrough and threading acorn nuts 39 onto the upper ends of the stud bolts 38.

As shown in FIGS. 1 and 2, the cylinder block 3 is provided with a bore 41 having a circular cross section passed therethrough, and the cylinder sleeve 42 is fitted into this bore 41 with the lower end thereof extending into the cylindrical recess 31 mentioned above. The bore 41 is provided with a large diameter section in an upper end thereof defining an annular shoulder 41*a* facing upward, and the cylinder sleeve 42 is provided with a radial flange 42*b* configured to rest on this annular shoulder 41*a*. The upper end part of the cylinder sleeve 42 (or the part thereof located above the radial flange 42*b*) defines an annular space 41*b* in cooperation with the large diameter section of the bore 41 of the cylinder block 3.

The cylinder sleeve 42 is provided with a constant inner diameter over the entire length thereof except for the lower end thereof which is chamfered, and the cylinder bore 3*a* is defined by an inner circumferential surface 42*a* of the cylinder sleeve 42. The outer diameter of the cylinder sleeve 42 is also constant over the entire length thereof except for the lower end thereof which is reduced in diameter over a certain length and a part adjacent to the upper end thereof which is provided with the radial flange 42*b* defining an annular shoulder surface abutting the annular shoulder 41*a* to determine the axial position of the cylinder sleeve 42 relative to the cylinder block 3. The upper end of the cylinder sleeve 42 is flush with the upper end surface of the cylinder block 3, and the cylinder sleeve 42 is provided with a somewhat greater vertical dimension than the cylinder block 3 so that the lower end of the cylinder sleeve 42 projects out of the lower end of the cylinder block 3 into the cylindrical recess 31 of the crankcase 2.

The cylinder sleeve 42 is provided with three scavenging orifices 42*c* and 42*d* passed across the thickness thereof. In the illustrated embodiment, the first scavenging orifices 42*c* are provided on either lateral side of the cylinder sleeve 42 to be 180 degrees apart from each other, and the second scavenging orifice 42*d* is provided on the front side of the cylinder sleeve 42. The first scavenging orifices 42*c* are identically shaped and dimensioned to each other, and the second scavenging orifice 42*d* is somewhat more elongated in the direction of the cylinder axial line 3X than the first scavenging orifices 42*c*. The upper edge of the second scavenging orifice 42*d* is at the same height as the upper edge of the first scavenging orifice 42*c*, but the lower edge of the second scavenging orifice 42*d* is lower than the lower edge of the first scavenging orifices 42*c*.

The lower end of the cylinder sleeve 42 is formed with a cutout 42*e* on the front side thereof, directly beneath the second scavenging orifice 42*d*. The cutout 42*e* is passed through the thickness (radial direction) of the cylinder sleeve 42, and extends to the lower edge of the cylinder sleeve 42.

As shown in FIG. 1, the part of the cylinder block 3 opposing each scavenging orifice 42*c*, 42*d* (surrounding the lower open end of the bore 41 of the cylinder block 3) is formed with a recess 3*b* defined by a curved wall surface which is configured to guide the mixture from the crank chamber 2*a* smoothly into the corresponding scavenging orifice 42*c*, 42*d*. In other words, each scavenging orifice 42*c*, 42*d* and the corresponding recess 3*b* jointly form a scavenging port 43 that communicates the crank chamber 2*a* and the cylinder bore 3*a* with each other via the cylindrical recess 31. In particular, the recesses 3*b* are formed on the lateral sides and the front side of the bore 41 of the cylinder block 3. The upper end of each recess 3*b* extends to the upper edge of the corresponding scavenging orifice 42*c*, 42*d*, and lower end of each recess 3*b* extends to the cylindrical recess 31 of the cylinder block 3.

For the convenience of description, the parts of the scavenging port 43 defined by the first scavenging orifices 42*c* and the second scavenging orifice 42*d* are referred to as a first scavenging port 43*a* and a second scavenging port 43*b*, respectively. The first scavenging orifices 42*c* and the second scavenging orifice 42*d* define the open ends of the first scavenging port 43*a* and the second scavenging port 43*b* on the side of the cylinder bore 3*a*, respectively. The upper end of each recess 3*b* is defined by an inwardly curved surface that guides the upward flow of the mixture smoothly into the corresponding scavenging orifice 42*c* and 42*d*.

As shown in FIGS. 1 and 2, the part of the lower surface of the cylinder head 4 corresponding to the cylinder bore 3*a* is recessed in a dome-shape (dome-shaped recess 4*a*) so as to define a combustion chamber 44 jointly with the top surface of the piston 22. An annular groove 4*b* is formed in the lower surface of the cylinder head 4 concentrically around the dome-shaped recess 4*a* which aligns with the annular space 41*b* defined between the upper part of the cylinder sleeve 42 and the surrounding wall of the cylinder block 3 such that a water jacket 45 surrounding the dome-shaped recess 4*a* of the cylinder head 4 and the upper part of the cylinder bore 3*a* is defined jointly by the annular space 41*b* and the annular groove 4*b*.

The cylinder head 4 is further provided with an exhaust port 46 opening out at the top end of the combustion chamber 44 and a plug hole for receiving a spark plug 47 therein. In the illustrated embodiment, the spark plug 47 is normally activated only at the time of starting the engine to ignite the mixture in the combustion chamber 44. The exhaust port 46 is provided with an exhaust valve 48 consisting of a poppet valve to selectively close and open the exhaust port 46. The exhaust valve 48 includes a valve stem which is slidably guided by the cylinder head 4 at an angle to the cylinder axial line 3X, and the stem end of the exhaust valve 48 extends into the upper valve chamber 6 containing a part of the valve actuating mechanism 50 for actuating the exhaust valve 48 via the stem end thereof.

The valve actuating mechanism 50 includes a valve spring 51 that resiliently urges the exhaust valve 48 in the closing direction (upward), an upper rocker shaft 53 supported by a block 52 provided on the cylinder head 4 and an upper rocker arm 54 rotatably supported by the upper rocker shaft 53. The upper rocker shaft 53 extends substantially perpendicularly to the crankshaft 8, and the upper rocker arm 54 extends substantially in parallel to the crankshaft 8. One end of the upper rocker arm 54 is provided with a socket 54*a* engaging the upper end 55*a* of the pushrod 55, and the other end of the upper rocker arm 54 is provided with a tappet adjuster 54*b* consisting of the screw which engages the stem end of the exhaust valve 48. The upper end 55*a* of the pushrod 55 is given with a semi-spherical shape, and the socket 54*a* of the rocker arm 54 receives the upper end 55*a* of the pushrod 55 in a complementary manner, allowing a certain sliding movement between them.

As shown in FIGS. 2 and 3, the pushrod 55 extends substantially vertically along a side of the cylinder block 3, and is received in a tubular rod case 56 having an upper end connected to the cylinder head 4 and a lower end connected to the lower valve case 17. In the illustrated embodiment, the rod case 56 extends along the exterior of the cylinder block 3.

Because the crankshaft 8 is offset from the cylinder axial line 3X (FIG. 1), as best shown in FIG. 3, the lower end of the rod case 56 is connected to a part of the upper wall of the lower valve case 17 laterally offset from the crankshaft 8. The lower valve chamber 18 receives the remaining part of the valve actuating mechanism 50. The lower wall of the lower valve case 17 is provided with a drain hole 57 for expelling the lubricating oil in the lower valve chamber 18 which is usually closed by a drain plug 58.

The valve actuating mechanism 50 further comprises a cam 61 carried by the part of the crankshaft 8 extending into the lower valve chamber 18, a lower rocker shaft 63 supported by the side wall 7S of the crankcase 2 and the valve chamber lid 19 in parallel with the crankshaft 8 and a lower rocker arm 64 pivotally supported by the lower rocker shaft 63 for cooperation with the cam 61. In other words, one of the extensions 14 of the crankshaft 8 (the right end thereof in FIG. 2) serves as the camshaft 66 for the cam 61.

As shown in FIG. 3, the lower rocker arm 64 includes a tubular portion 64*a* rotatably supported by the lower rocker shaft 63, a first arm 64*b* extending from the tubular portion 64*a* toward the crankshaft 8, a roller 64*c* pivotally supported by the free end of the first arm 64*b* to make a rolling contact with the cam 61, a second arm 64*d* extending from the tubular portion 64*a* away from the first arm 64*b*, and a receiving portion 64*e* formed in the free end of the second arm 64*d* to support the lower end 55*b* of the pushrod 55. The lower end of the pushrod 55 is given with a semi-spherical shape, and the receiving portion 64*e* is formed as a recess complementary to the semi-spherical lower end of the pushrod 55 so as to receive the lower end of the pushrod 55 in a mutually slidable manner.

As shown in FIG. 1, the upper front part of the crankcase 2 opposing the cylindrical recess 31 is formed with an injector hole 70 passed through the wall of the crankcase 2. The inner open end of the injector hole 70 directly communicates with the second scavenging port 43*b*, and opposes the second scavenging orifice 42*d*. The axial line of the injector hole 70 extends obliquely upward as seen from outside (front side), and passes through a central part of the second scavenging orifice 42*d*.

A fuel injection device 71 is received in the injector hole 70. The fuel injection device 71 consists of a per se known fuel injection device, and comprises an internal fuel passage (not shown in the drawings), a nozzle 72 provided at the front end of the device and communicating with the fuel passage, a valve element (not shown in the drawings) configured to open and close the fuel passage, and an actuator (not shown in the drawings) for actuating the valve element. The actuator may consist of a solenoid, a piezo actuator or the like, and is configured to actuate the valve element according to the electric power supplied by an electro control unit (not shown in the drawings). The nozzle 72 consists of a tubular member, and defines a fuel injection orifice at the front end thereof. The nozzle 72 is placed in the injector hole 70 in such a manner that the fuel injection orifice at the front end is directed to the second scavenging port 43 (cylindrical recess 31). The fuel injection device 71 is fixedly secured in the injector hole 70 by a retaining member 74 which is in turn fixedly secured to the exterior of the crankcase 2 by using a screw.

The fuel injection device 71 ejects fuel from the fuel injection orifice at a prescribed angle or along an injection axial line 71X, forming a cone of fuel of a certain cone angle. The injection axial line 71X is coaxial with the axial line of the injector hole 70 and the axial line of the nozzle 72, and has an upward slant as one moves from the front to the rear of the engine so as to pass the second scavenging orifice 42*d*. More specifically, the fuel injection device 71 ejects fuel onto the inner circumferential surface 42*a* of the cylinder sleeve 42 via the cylindrical recess 31, the recess 3*b* and the second scavenging orifice 42*d*. When the lower end of the piston 22 passes near the upper edge of the second scavenging orifice 42*d*, and the injection axial line 71X of the fuel injection device 71 passes the back side of the piston 22, the fuel injection device 71 ejects fuel onto the back side of the piston 22 via the cylindrical recess 31, the recess 3*b* and the second scavenging orifice 42*d*.

The fuel that is injected by the fuel injection device 71 may consist of liquid fuel such as gasoline, diesel oil, kerosene and biofuel, or gas fuel such as city gas and LP gas. Liquid fuel is preferred because the latent heat at the time of evaporation promotes removal of heat from the piston 22 and the cylinder sleeve 42. Diesel fuel is preferred among other liquid fuels because of the favorable lubricating property thereof. When the fuel is provided with a lubricating property, the fuel that deposits on the inner circumferential surface 42*a* of the cylinder sleeve 42 provides a lubrication for the relative sliding movement between the piston 22 and the cylinder 42.

The engine E1 described above operates as described in the following at the time of start-up. Referring to FIG. 1, in the upward stroke of the piston 22, owing to the depressurization of the crank chamber 2*a*, the reed valve 33 opens. As a result, the fresh air metered by the throttle valve 34*b* is drawn into the crank chamber 2*a* via the reed valve 33 and the intake port 32. The fuel injection device 71 then injects fuel into the crank chamber 2*a* to be mixed with the fresh air therein. The mixture in the cylinder bore 3*a* is compressed by the piston 22, and is ignited by the spark from the spark plug 47 when the piston 22 is near the top dead center.

The piston 22 then undergoes a downward stroke, and because the reed valve 33 is closed at this time, the mixture in the crank chamber 2*a* is prevented from flowing back to the throttle valve 34*b*, and compressed. During the downward stroke of the piston 22, before the piston 22 opens the scavenging port 43, the exhaust valve 48 actuated by the valve actuating mechanism 50 according to the cam profile of the cam 61 opens the exhaust port 46. Once the piston 22 opens the scavenging port 43, the compressed mixture is introduced into the cylinder bore 3*a* (combustion chamber 44) via the scavenging port 43. The combustion gas in the combustion chamber 44 is displaced by this mixture, and is expelled from the exhaust port 46 while part of the combustion gas remains in the combustion chamber 44 as EGR gas. The valve opening timing of the exhaust valve 48 is determined such that the amount of the EGR gas remaining in the combustion chamber 44 is great enough for the self-ignition of the mixture to take place owing to the rise in the temperature of the mixture in the combustion chamber 44 under compression with the increase in the amount of the EGR gas.

When the piston 22 undergoes an upward stroke once again, the piston 22 closes the scavenging port 43, and, thereafter, the exhaust valve 48 actuated by the first cam 61 closes the exhaust port 46. As a result, the mixture in the cylinder bore 3*a* (combustion chamber 44) is compressed while the crank chamber 2*a* is depressurized, causing the mixture to be drawn thereinto via the reed valve 33. Once the engine E1 is brought into a stable operation, the mixture is self-ignited as the piston 22 comes near the top dead center, and the combustion gas created by the resulting combustion pushes down the piston 22.

The engine E1 thus performs a two-stroke operation. In particular, spark ignition using the spark plug 47 is required at the time of start up, but once the engine starts operating in a stable manner, a two-stroke operation based on a homogeneous charge compression ignition is performed. The scavenging flow from the scavenging port 43 to the exhaust port 46 via the cylinder bore 3*a* is guided along a relatively straight path, or the so-called "uni-flow scavenging" can be achieved.

Figure 5:
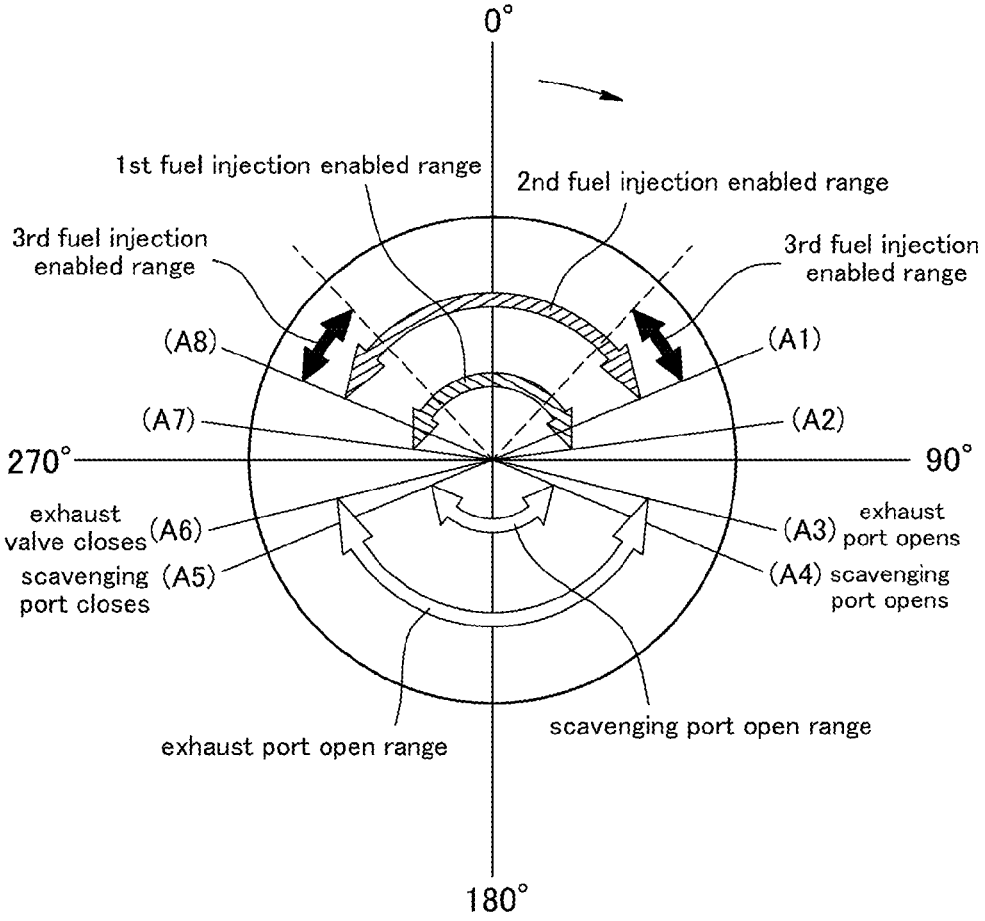
FIG. 5 is a diagram illustrating the fuel injection timing of the first embodiment.

FIG. 5 shows the timing of fuel injection by the fuel injection device 71 with respect to the position of the piston 22 (or the crank angle) in the engine E1 of the first embodiment. The top dead center of the piston 22 is represented by 0 degrees, and the bottom dead center of the piston 22 is represented by 180 degrees. The downward stroke of the piston 22 occurs over the angular range of 0 to 180 degrees, and the upward stroke of the piston 22 occurs over the angular range of 180 to 360 degrees.

When the piston position is at 0 degrees (top dead center), the fuel in the combustion chamber 44 burns, and the gas within the combustion chamber 44 expands, thereby forcing the piston 22 downward from the top dead center. Until the piston position reaches position A1, the lower end of the piston 22 is located above the upper edge of the second scavenging orifice 42*d*, and the second scavenging port 43*b* communicates with the part of the cylinder bore 3*a* located below the piston 22. Once the piston position reaches position A1, the lower end of the piston 22 coincides with the upper edge of the second scavenging orifice 42*d*. During the time the piston position is between position A1 and position A2, the second scavenging orifice 42*d* is progressively closed by the downward stroke of the piston 22. Once the piston position reaches position A2, the lower end of the piston 22 coincides with the lower edge of the second scavenging orifice 42*d* so that the communication between the second scavenging port 43*b* and the part of the cylinder bore 3*a* below the piston 22 is closed.

The piston 22 continues the downward movement, and when the piston position has reached position A3, the exhaust valve 48 opens, and the combustion gas begins to be expelled. When the piston position A4 has been reached, the upper end of the piston 22 coincides with the upper edge 42*d* of the second scavenging orifice 42*d*, and the communication between the second scavenging port 43*b* and the part of the cylinder bore 3*a* above the piston 22 is established.

After reaching the piston position of 180 degrees (bottom dead center), the piston 22 starts moving upward, and once the piston position A5 is reached, the upper end of the piston 22 coincides with the upper edge of the second scavenging orifice 42*d*, and the communication between the second scavenging port 43*b* and the part of the cylinder bore 3*a* above the piston 22 is shut off. The piston position range of A4 to A5 corresponds to the open period for the first and second scavenging ports 43*a* and 43*b*.

When the piston 22 reached position A6 following the subsequent upward stroke of the piston 22, the exhaust valve 48 is closed. The piston position range of A3 to A6 corresponds to the open period for the exhaust port 46.

When the piston 22 has moved upward to position A7, the lower end of the piston 22 coincides with the second scavenging orifice 42*d*, and this starts the communication between the second scavenging port 43 and the part of the cylinder bore 3*a* under the piston 22. When the piston 22 is in the range of positions A7 to A8, the upward stroke of the piston 22 causes the second scavenging orifice 42*d* to be opened, and once the piston position reaches A8, the lower end of the piston 22 coincides with the upper edge of the second scavenging orifice 42*d*, thereby fully opening the second scavenging orifice 42*d*.

The fuel injection device 71 may inject fuel during the period ranging from position A7 where the lower end of the piston 22 coincides with the lower edge of the second scavenging orifice 42*d* during the upward (compression) stroke of the piston 22 to position A2 where the lower end of the piston 22 coincides with the lower edge of the second scavenging orifice 42*d* during the downward (expansion) stroke of the piston 22. During this first injection enabled period (A7 to A2), because the second scavenging orifice 42*d* communicates with the part of the cylinder bore 3*a* located below the piston 22, the fuel is injected into the part of the cylinder bore 3*a* located below the piston 22, instead of the combustion chamber 44.

The fuel injection device 71 may also inject fuel during the period ranging from position A8 where the lower end of the piston 22 coincides with the upper edge of the second scavenging orifice 42*d* during the upward (compression) stroke of the piston 22 to position A1 where the lower end of the piston 22 coincides with the upper edge of the second scavenging orifice 42*d* during the downward (expansion) stroke of the piston 22. During this second injection enabled period (A8 to A1), because the second scavenging orifice 42*d* communicates with the part of the cylinder bore 3*a* located below the piston 22, and the lower end of the piston 22 is located above the upper edge of the second scavenging orifice 42*d*, the fuel is injected into the part of the cylinder bore 3*a* located below the piston 22, instead of the combustion chamber 44 or the outer circumferential surface of the piston 22.

When the fuel is injected during a third injection enabled period (indicated by the bold arrow in FIG. 5) where the lower end of the piston 22 is located near the upper edge of the second scavenging orifice 42*d*, as the back side of the piston 22 is located on the fuel injection axial line 71X of the fuel injection device 71, the fuel is impinged upon the back side of the piston 22. The third injection enabled period may be defined as the period during which the fuel injection axial line 71X of the fuel injection device 71 directly passes the back side of the piston 22 without being obstructed by any object such as the outer circumferential surface of the piston 22.

The fuel injection device 71 may inject fuel at least during the first fuel injection enabled period, preferably during the second fuel injection enabled period, and most preferably during the third fuel injection enabled period.

In the engine E1, because fuel in injected upon the back side of the piston 22 and the part of the inner circumferential surface 42*a* of the cylinder sleeve 42 located below the piston 22, the piston 22 and the cylinder sleeve 42 are favorable cooled by the injected fuel. Particularly when the fuel consists of liquid fuel, the evaporation of the fuel provides an even more favorable cooling of the piston 22 and the cylinder sleeve 42. At the same time, the fuel is favorably vaporized by the contact with the piston 22 and the cylinder sleeve 42 which are relatively high in temperature so that the vaporization of the fuel and the uniformity of the mixture in the crank chamber 2*a* are enhanced.

The fuel injected upon the back side of the piston 22 and the part of the inner circumferential surface of the cylinder sleeve 42 located below the piston 22 is squeezed downward by the downward stroke of the piston 22, and favorably mixed with the mixture in the crank chamber 2*a*.

Because the fuel injection device 71 impinges the fuel upon the back side of the piston 22 and the inner circumferential surface 42*a* of the cylinder sleeve 42 from the second scavenging orifice 42*d*, the fuel can reach such parts without being obstructed by the crankshaft 8. Also, because the distance which the fuel has to travel before reaching such parts is relatively short, a large part of the fuel can be delivered to such parts in an efficient manner.

Because the second scavenging orifice 42*d* is more vertically elongated than the first scavenging orifices 42*c*, the upward inclination of the fuel injection axial line 71X of the fuel injection device 71 that passes through the second scavenging orifice 42*d* can be maximized. This further improves the efficiency of delivering the fuel to the back side of the piston 22.

A second embodiment of the present invention is described in the following with reference to FIGS. 6 and 7. The engine E2 of the second embodiment differs from the engine E1 of the first embodiment in the position of the fuel injection device 71 in the engine main body 1. In the following description, the parts corresponding to those of the previous embodiment are denoted with like numerals without necessarily repeating the description of such parts.

Figure 6:
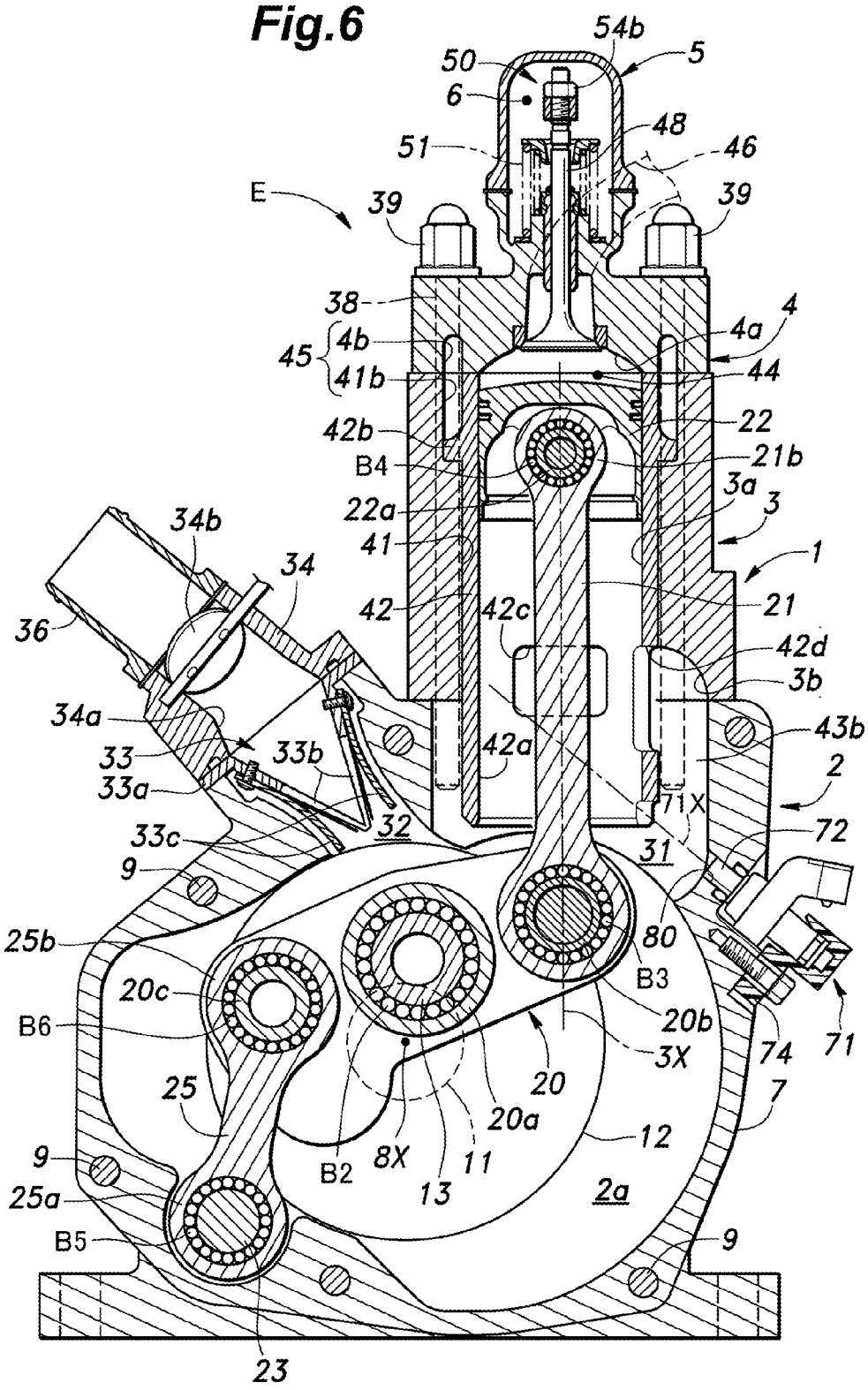
FIG. 6 is a view similar to FIG. 1 showing a second embodiment of the present invention.

As shown in FIG. 6, in the engine E2, the injector hole 80 is placed in an upper front part of the crankcase 2 adjoining the cylindrical recess 31, lower than the lower end of the cylinder sleeve 42. The injector hole 80 is passed through the wall of the crankcase 2, and the inner open end of the injector hole 80 communicates with the second scavenging port 43*b* via the cylindrical recess 31. The axial line of the injector hole 80 is upwardly slanted as one moves from the front to the rear, and the extension line of the axial line of the injector hole 80 passes through the lower opening or the cutout 42*e* of the cylinder sleeve 42.

The fuel injection device 71 is received in the injector hole 80, and the nozzle 72 of the fuel injection device 71 is placed in the injector hole 80 so that the injection orifice at the front end is directed to the second scavenging orifice 42*d* (cylindrical recess 31).

The injection axial line 71X of the fuel injection device 71 is disposed coaxial with the axial line of the injector hole 80, and is given with an upward slant (as one moves from the front to the rear) so as to pass through the lower open end or the cutout 42*e* of the cylinder sleeve 42. Therefore, the fuel injection device 71 ejects fuel onto the inner circumferential surface 42*a* of the cylinder sleeve 42 via the cylindrical recess 31, and the lower open end and the cutout 42*e* of the cylinder sleeve 42. When the piston 22 is near the bottom dead center, the fuel injection device 71 injects fuel onto the back side of the piston 22 via the cylindrical recess 31, and the lower open end and the cutout 42*e* of the cylinder sleeve 42.

Figure 7:
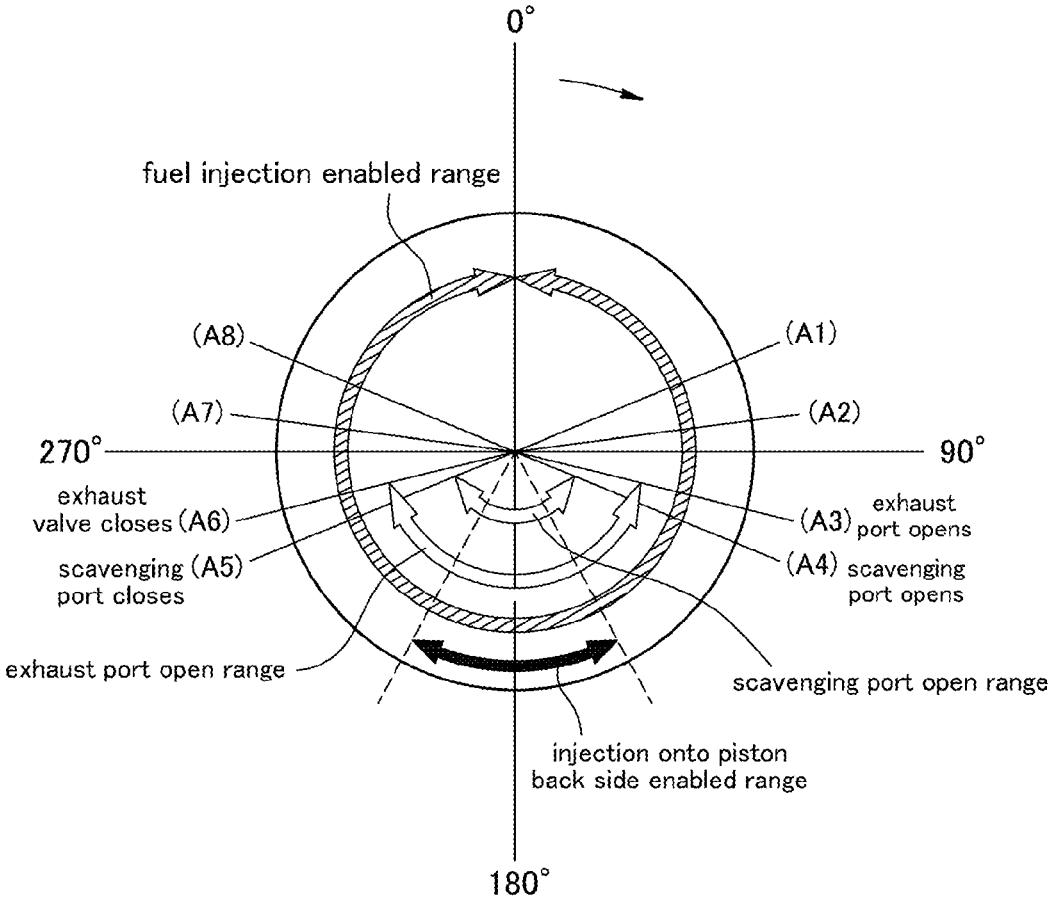
FIG. 7 is a diagram illustrating the fuel injection timing of the second embodiment.

FIG. 7 shows the timing of fuel injection by the fuel injection device 71 with respect to the position of the piston 22 (or the crank angle) in the engine E2 of the second embodiment.

In the engine E2 of the second embodiment, the fuel injection device 71 injects fuel onto the piston 22 and the cylinder sleeve 42 via the lower open end of the cylinder sleeve 42 which is always in communication with the crank chamber 2*a*, and is shut off from the combustion chamber 44 by the piston 22. Therefore, the fuel injection device 71 may inject fuel at any timing. When the fuel is injected while the piston 22 is near the bottom dead center (region indicated by the solid arrow in FIG. 7), because the back side of the piston 22 is located on the fuel injection axial line 71X of the fuel injection device 71, the fuel may be injected upon the back side of the piston 22. The range over which fuel may be injected upon the back side of the piston 22 by the fuel injection device 71 may defined as the range over which the fuel injection axial line 71X of the fuel injection device 71 passes through the back side of the piston 22 without being obstructed by an object (such as the inner circumferential surface of the piston 22).

Because the cutout 42*e* is provided in the lower end of the cylinder sleeve 42, the freedom in the positioning of the fuel injection device 71 such that the fuel may be injected upon the inner circumferential surface or the back side of the piston can be increased. Owing to the provision of the cutout 42*e*, the slanting angle of the fuel injection axial line 71X with respect to the horizontal line can be made smaller by making the fuel injection axial line 71X pass through the cutout 42*e*, and the position of the fuel injection device 71 can be brought closer to the lower end of the cylinder sleeve 42 than is otherwise possible. As a result, the fuel injection device 71 can be placed relatively remote from the crankshaft 8 and the trigonal link 20, thereby avoiding the fuel injection device 71 from being interfered by the crankshaft 8 and the trigonal link 20.

The engine E2 includes a multiple link mechanism 30 including the trigonal link 20, and the crankshaft 8 is placed in a position rearwardly offset from the cylinder bore 3*a*. As a result, the fuel injection device 71 placed in the front part of the crankcase 2 can be brought very close to the cylinder sleeve 42 with respect to the fore and aft direction without interfering with the crankshaft 8.

Although the present invention has been described in terms of preferred embodiments thereof, it is obvious to a person skilled in the art that various alterations and modifications are possible without departing from the scope of the present invention. For instance, the axial line 71X of the fuel injection device 71 may be at an angle to the axial line of the nozzle 72. Thereby, the freedom in the positioning of the fuel injection device 71 can be increased.

The contents of the original Japanese patent application on which the Paris Convention priority claim is made for the present application as well as the contents of the prior art references mentioned in this application are incorporated in this application by reference.

The invention claimed is:

1. A two-stroke engine, comprising:

a piston slidably received in a cylinder bore defined in an engine main body;

a scavenging port having an upper open end opening out in a side wall of the cylinder bore and a lower open end communicating with a crank chamber, the upper open end being configured to be closed and opened by the piston; and a fuel injection device mounted on the engine main body and configured to inject fuel onto a back side of the piston and/or a part of the side wall of the cylinder bore located under the piston, wherein the fuel injection device is mounted on a part of the engine main body defining a part of the scavenging port, and wherein the fuel injection device is configured to inject fuel during a period while a lower end of the piston is located higher than a lower edge of the upper open end of the scavenging port, and a part of the cylinder bore located under the piston communicates with the scavenging port.

2. The two-stroke engine according to claim 1, wherein a fuel injection axial line of the fuel injection device is directed obliquely upward, and passes through the open end of the scavenging port.

3. A two-stroke engine, comprising:

a piston slidably received in a cylinder bore defined in an engine main body;

a scavenging port having an open end opening out in a side wall of the cylinder bore and communicating with a crank chamber, the open end configured to be closed and opened by the piston; and a fuel injection device mounted on the engine main body and configured to inject fuel onto a back side of the piston and/or a part of the side wall of the cylinder bore located under the piston, wherein a fuel injection axial line of the fuel injection device is directed obliquely upward, and passes through an open lower end of the cylinder bore.

4. The two-stroke engine according to claim 1, wherein the fuel injection device is configured to inject liquid fuel.

5. The two-stroke engine according to claim 4, wherein the liquid fuel is provided with a lubricating property.

6. The two-stroke engine according to claim 1, further comprising:

a crankshaft extending in the engine main body with an offset relative to an axial line of the cylinder bore and provided with a crankpin;

a trigonal link having a middle part pivotally supported by the crankpin;

a connecting rod having a first end pivotally connected to an end of the trigonal link and a second end pivotally connected to the piston; and a swing link having a first end pivotally connected to another end of the trigonal link and a second end pivotally connected to the engine main body, wherein the fuel injection device is mounted on a part of the engine main body adjacent to the crank chamber and located on a side of the cylinder bore axial line remote from the axial line of the crankshaft such that fuel ejected from the fuel injection device is directed into the cylinder bore.

7. The two-stroke engine according to claim 3, wherein the fuel injection device is configured to inject liquid fuel.

8. The two-stroke engine according to claim 1, wherein the liquid fuel is provided with a lubricating property.

9. The two-stroke engine according to claim 3, wherein the engine further comprises a crankshaft extending in the engine main body with an offset relative to an axial line of the cylinder bore and provided with a crank pin, a trigonal link having a middle port pivotally supported by the crank pin, a connecting rod having a first end pivotally connected to an end of the trigonal link and a second end pivotally connected to the piston, and a swing link having a first end pivotally connected to another end of the trigonal link and a second end pivotally connected to the engine main body, and wherein the fuel injection device is mounted on a part of the engine main body adjacent to the crank chamber and located on a side of the cylinder bore axial line remote from the axial line of the crankshaft such that fuel ejected from the fuel injection device is directed into the cylinder bore.

* * * * *